US006438975B1

(12) United States Patent
De Graaf

(10) Patent No.: US 6,438,975 B1
(45) Date of Patent: Aug. 27, 2002

(54) APPARATUS FOR THE SELECTION AND AUTOMATIC DISPENSING OF PRODUCTS SUCH AS FOOD PRODUCTS

(75) Inventor: Mattijn Godewijn De Graaf, Leiden (NL)

(73) Assignee: Veroost Innovatie B.V., Vijfhuizen (NL)

( * ) Notice: Subject to any disclaimer, the term of this patent is extended or adjusted under 35 U.S.C. 154(b) by 0 days.

(21) Appl. No.: 09/402,574

(22) PCT Filed: Apr. 8, 1998

(86) PCT No.: PCT/NL98/00199

§ 371 (c)(1),
(2), (4) Date: Dec. 3, 1999

(87) PCT Pub. No.: WO98/45819

PCT Pub. Date: Oct. 15, 1998

(30) Foreign Application Priority Data

Apr. 8, 1997 (NL) ..... 1005751

(51) Int. Cl.[7] ..... G07F 9/02

(52) U.S. Cl. ..... 62/127; 221/5; 222/25; 62/378

(58) Field of Search ..... 221/2, 4, 5, 8; 222/25, 26, 27, 28; 62/125, 126, 127, 129, 130, 378, 380, 381, 382

(56) References Cited

U.S. PATENT DOCUMENTS

| | | | | | |
|---|---|---|---|---|---|
| 4,638,312 | A | * | 1/1987 | Quinn et al. | 340/825.35 |
| 4,803,348 | A | * | 2/1989 | Lohrey et al. | 235/381 |
| 5,499,707 | A | * | 3/1996 | Steury | 194/217 |
| 5,520,941 | A | * | 5/1996 | Oosterling | 426/232 |
| 5,690,251 | A | * | 11/1997 | Wade | 221/76 |
| 6,019,246 | A | * | 2/2000 | Yajima et al. | 221/2 |
| 6,272,394 | B1 | * | 8/2001 | Lipps | 221/2 X |

FOREIGN PATENT DOCUMENTS

| | | | | |
|---|---|---|---|---|
| DE | 3617980 | A1 | * | 12/1987 |
| DE | 3812450 | A1 | * | 11/1988 |
| DE | 4226645 | A1 | * | 2/1994 |
| EP | 0 092 368 | A2 | * | 10/1983 |
| EP | 0 470 673 | A1 | * | 2/1992 |
| EP | 0 535 913 | A2 | * | 4/1993 |
| EP | 0 608 147 | A1 | * | 7/1994 |
| EP | 0 672 587 | A1 | * | 2/1995 |

* cited by examiner

*Primary Examiner*—Harry B. Tanner
(74) *Attorney, Agent, or Firm*—Darby & Darby

(57) ABSTRACT

An apparatus for the selection and automatic dispensing of products, such as food products. The products are stored in a storage cabinet, where a detachment device cuts them into a dispensable form for dispensing. An operating panel enables the consumer to make selections simple and quickly.

10 Claims, 2 Drawing Sheets

Figure 1:
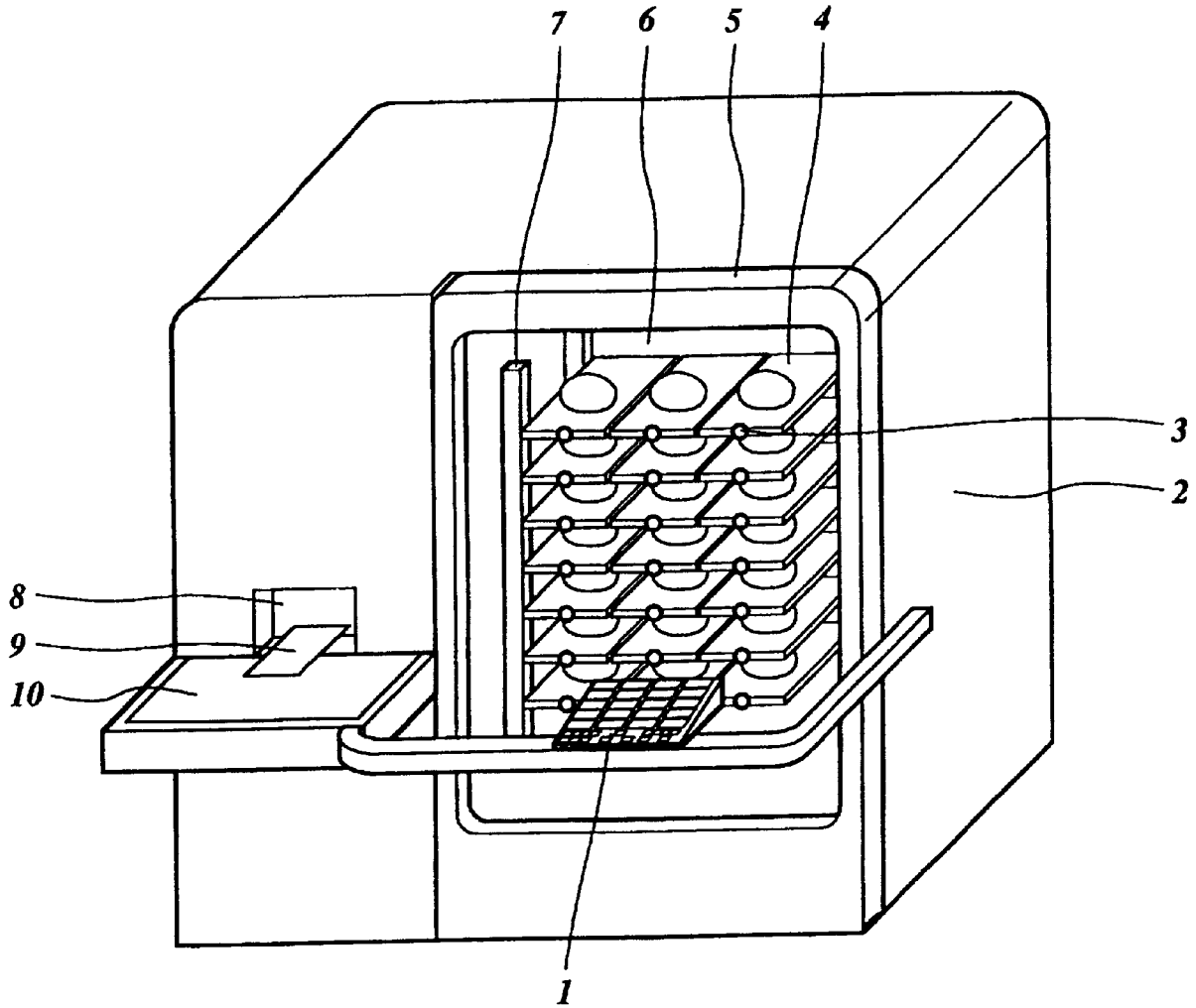

APPARATUS FOR THE SELECTION AND AUTOMATIC DISPENSING OF PRODUCTS SUCH AS FOOD PRODUCTS

BACKGROUND AND SUMMARY OF THE INVENTION

The invention relates to an apparatus for the selection and automatic dispensing of products such as food products, comprising at least a storage cabinet for the unwrapped storage of products, detachment means for the removal of the stored products in a dispensable form, control means comprising, among other things, a memory and an operating panel which is connected with the control means and which is provided with selection means for, among other things, the selection of the type of product to be dispensed, the desired quantity and optionally the form in which the product is to be dispensed.

Such an apparatus is known from EP 0 470 673. The apparatus described in this document is used for slicing meat products stored in a refrigerated atmosphere or an atmosphere provided with protective gas, the user conveying his order to the control system by means of an operating panel. Practice has shown that the apparatus slices the meat product and carries out the order in a very short time and that the performance of the apparatus is limited by the time required to pass the order on to the control stem. Such an apparatus is used, for instance in a shop, by many different people who are not familiar with operating panels and who are not trained to use them. Putting an order through to the control system seems to cause much delay, which limits the performance of the apparatus.

In order to avoid this disadvantage, the selection means of the apparatus according to the invention have separate selection positions for all possible options, and are provided with indicator means to indicate the selection that has been made.

By offering a choice of selection positions for all the possible options the user is enabled to choose quickly, and immediately after the selection is made, indicator means display his selection, so that he is immediately able to make adjustments if necessary. This allows the user to make his choice more quickly and to correct any errors quickly. The fact that there is less loss of time ensures that the apparatus is used more efficiently.

In U.S. Pat. No. 4,638,312 to Quinn, et al. an order system is disclosed for order entry in a fast food restaurant. In a fast food restaurant a client selects his order from a limited list whereby there is no variety in the items that can be chosen and the selected items are prepared and packaged in the required quantity of selected items. In this order entry system there are no options for the selected items, only the quantity of the items can be changed.

In accordance with an improvement of the invention, the control means are designed such that after a product has been selected, the indicator means display a stored standard setting of options associated with a product on the operating panel.

This aids the user in making his choice, and the setting selected as standard is the one that will be used for the majority of the orders. As a result, the choice will be made more quickly and the order can be carried out faster.

In accordance with a further improvement of the invention the control means comprise a counter for the registration of the selections made per product and an adjustment device which, in concurrence with the counter, adjusts the standard setting associated with a product. In this way the standard setting can be adjusted to the setting used most frequently.

In accordance with one embodiment of the invention, the selection means are push buttons comprising lamps as indicator means. The use of lamps with the buttons provides an easily visible direct feedback with respect to the selections made.

In accordance with an embodiment of the invention in which the various kinds of products are visible in the storage cabinet, indicator means are provided near the selectable products, to indicate the provisionally selected product. This allows the consumer to compare the product selected on the operating panel with the product that will be cut off. This comparison facilitates the use of the operating panel for people who are not accustomed to using such panels.

U.S. Pat. No. 6,272,394 to Lipps describes a system whereby lights are used for locating a stored quantity of a product in a rack in order to manually take a quantity of the product out of the rack.

The invention also relates to an apparatus which is embodied such that the detachment means comprise a cutting device for slicing foodstuffs such as, for instance, meat products, and the selection means for the quantity comprise a first subgroup for the selection of the weights and a second subgroup for the selection of the number of slices. This offers sufficient quantity options because it is possible for one thing to select a fixed weight, or for another thing a quantity in which not the weight is important for the customer, but the number of slices.

In accordance with a further improvement of the invention the temperature in the storage cabinet is some degrees below freezing point. Due to the fact that the meat products and the cutting device have a temperature of some degrees below freezing point, even meat products that are difficult to slice, for instance, because they have a high fat content, can be thinly sliced. The temperature at the bottom of the storage cabinet is then preferably about 8° below freezing point and at the top of the cabinet at least 20° below freezing point. The meat products which due to their fat content are the most difficult to slice, are stored at the bottom.

BASIC DESCRIPTION OF THE DRAWINGS

Figure 2:
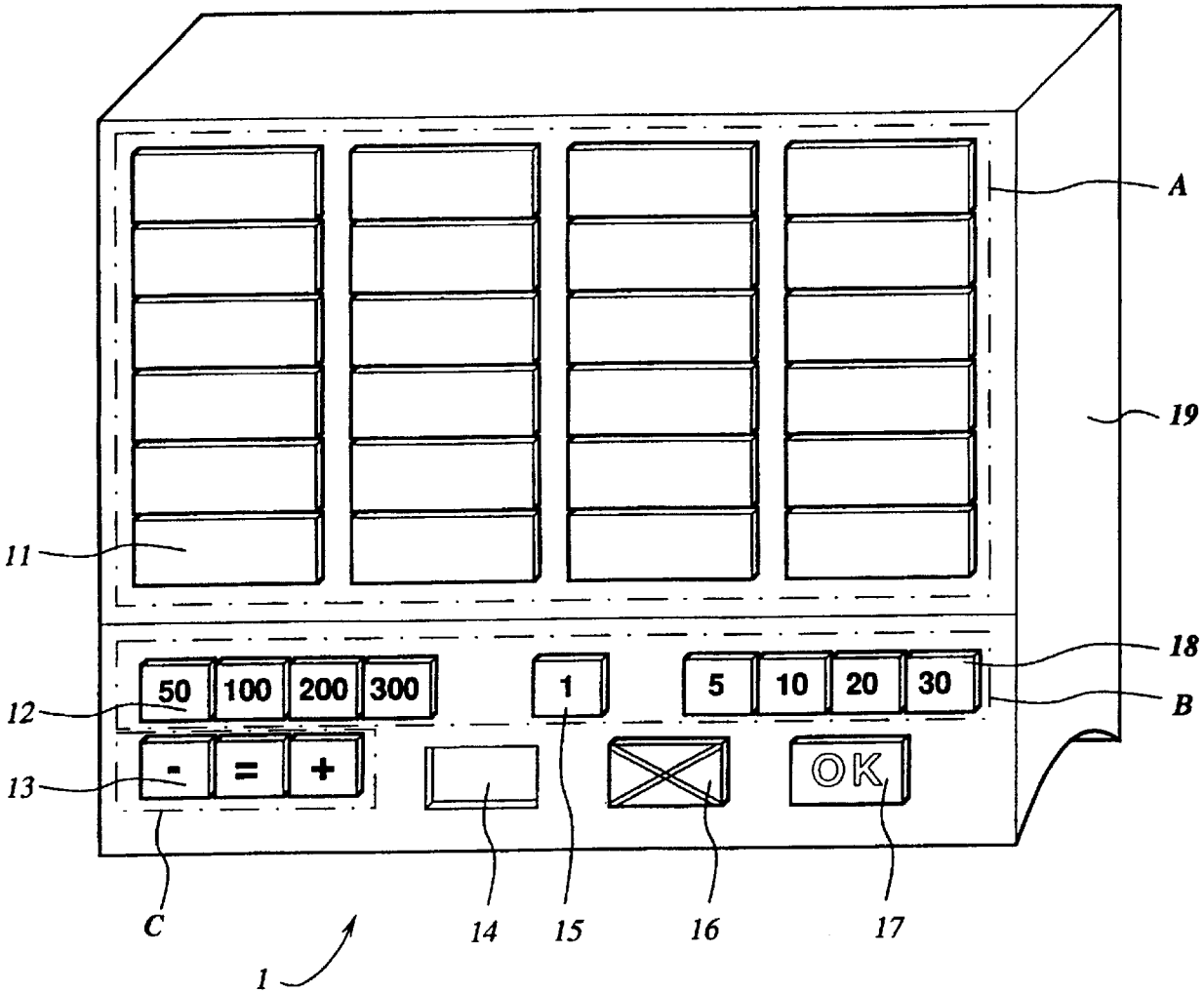

The invention will now be explained in more detail with reference to one explanatory embodiment including a drawing, in which FIG. 1 shows the storage cabinet, and FIG. 2 shows the operating panel.

DETAILED DESCRIPTION OF THE DRAWINGS

FIG. 1 shows a storage cabinet 2, provided with a door 5, in which a window 6 is fitted. In the storage cabinet 2 a storage rack 7 is placed provided with presentation shelves 4 for meat products. The storage cabinet 2 is equipped with refrigeration for keeping foodstuffs, in this case meat products, at some degrees below freezing point. Optionally a gas-metering device is installed for metering gasses which promote the preservation of the stored meat products. In order to prevent condensation on the window 6, said window may be provided, in the usual manner, with heating.

In the bottom part of the storage cabinet 2 a slicing device (not shown) is placed. There are conveyor means for transporting the presentation shelves 4 with the meat products to the slicing device where the ordered amount of meat can be cut off.

Due to the fact that the meat products are kept near or slightly below freezing point, even meat products that are difficult to slice, such as for instance fatty bacon and other meat products with a high fat content, can be sliced quite easily. It has been found that at an average temperature of 4 degrees below freezing point the stored meat products are not frozen and that it is always possible to thinly slice meat products of this temperature.

It has been found that the temperature in the storage cabinet is not everywhere the same, because this would require very considerable air circulation. In practice a temperature of 8° below freezing point can be maintained in the bottom part of the storage cabinet, while in the top part of the cabinet the temperature is at least 2° below freezing point. By placing the fatty meats and those that are difficult to slice in the bottom part of the cabinet, their sliceability is maintained. The meats with a somewhat lower fat content are placed in the top part of the storage cabinet.

Because the meat products are stored at this temperature, said temperature pervades the meat through and through. The slicing device is located in the same storage cabinet and also has this temperature, so that even the meat products which are difficult to slice can be sliced thinly without the knife locally heating the meat during slicing.

The sliced meat product is weighed, wrapped and the price is printed on the wrapping, after which a conveyor belt 9 conveys it through a dispenser opening 8 to a dispenser shelf 10. The consumer retrieves his order from the dispenser shelf 10.

To place his order, the consumer uses an operating panel 1 provided at the front of the storage cabinet 2, the choice of meat product being visible through the window 6. On or near each shelf bearing a meat product an indicator lamp 3 is provided and is visible through the window 6. When a meat product has been selected the indicator lamp 3 on the shelf of choice lights up, allowing the consumer to check whether he made the correct selection. To avoid the window 6 becoming non-transparent due to frosting up or condensation, it may be provided in the usual manner with heating wires.

The operating panel 1 is connected with a control system (not shown) provided in or near the storage cabinet 2 which controls the various components of the apparatus. The control system is provided with a memory in which the various data concerning the meat products are stored. For the input of these and other data there are separate facilities such as, for instance a separate operating panel, which, however, is mounted such as to be invisible or inoperable for the consumer.

Apart from the embodiment having one single window 6 as shown in FIG. 1, it is also possible to provide the storage cabinet 2 with several windows 6, for instance, at both sides of the dispensing shelf 10 or next to each other and also having several operating panels 1.

FIG. 2 shows the operating panel 1 on which the various buttons are represented schematically. Under each button there is a lamp which lights up or blinks when a button is pressed and the input has been accepted by the control unit. If the control unit identifies a product as being no longer available, an indicator lamp 14 lights up.

A first group of buttons A comprises a number of product selection buttons 11. Each selection button 11 gives a description of the product, for instance, "ham", as well as the price per quantity. The buttons for products with similar characteristics are placed together as much as possible.

A second group of buttons B serves to indicate the quantity of meat product to be sliced off. This can be done by means of a weight selection button 12 for selecting a certain weight, by means of a thick-slice selection button 15 for selecting a thick slice or by means of a multiple-slices selection button 18 for selecting the number of slices to be cut off.

A third group of buttons C includes a slice-thickness selection button 13, which offers a choice between a slice of standard thickness, a thin slice or a thick slice.

When a product has been selected by pressing a product-selection button 11, the respective button lights up as does the indicator lamp 3 in the storage cabinet 2. Simultaneously with these indicator lamps a button of the second group B and a button of the third group C also light up, namely the option which is the most common one used or standard option. If a consumer wishes to choose something different, then he or she presses the respective selection button and after acceptance in the control system the respective button lights up.

In addition to the selection sequence described above, i.e. first selecting the product, it is also possible to use a different selection sequence, for instance, by first selecting the weight or first the thickness of the slice.

If all the selections are satisfactory, the consumer presses an ordering button 17, after which the apparatus will slice the meat product in accordance with the order. Immediately after an order is placed a following order may be placed because the first order is stored in the control unit until the order has been carried out.

The control unit of the apparatus is provided with a memory in which the various settings are fixed. Because a number of settings depend on the local use of the apparatus, the control unit has been equipped to register the use and to adjust the settings. For this purpose part of the memory registers which orders have been placed and which adjustments have been made with regard to the standard settings. Based on these data the standard settings can be adjusted automatically, or the results can be made available, based on which the settings of the control system can be adjusted.

What is claimed is:

1. An apparatus for the selection and automatic dispensing of products, comprising:

at least a storage cabinet for storing unwrapped products, detachment means for removing the stored products in a dispensable form, control means comprising:

a memory and an operating panel operably connected to the control means, a selection means for selecting at least one of a type of product which is dispensed, a desired quantity and form in which the product is dispensed, and indicator means for indicating the selection of at least one type of product for dispensing and a desired quantity and form in which the product is dispensed;

wherein the selection means has separate selection positions for all available products and options.

2. The apparatus according to claim 1, wherein the control means are configured such that after the product has been selected, the indicator means display a stored standard setting of options associated with the product on an operating panel.

3. The apparatus according to claim 2, wherein the control means comprise a counter for registering selections made per product and an adjustment device which, concurrently with the counter, adjusts standard settings associated with the product.

4. The apparatus according to claim 1, wherein the selection means are push buttons comprising lamps as indicator means.

5. The apparatus according to claim 4, wherein various kinds of products are visible in the storage cabinet, and wherein indicator means are provided near selectable products to indicate products which are provisionally selected.

6. An apparatus according to claim 5, further comprising:

detachment means comprising a cutting device for slicing foodstuffs, wherein a selection means for the quantity comprise a first subgroup for the selection of the weights and a second subgroup for the selection of the number of slices.

7. The apparatus according to claim 6, wherein the storage cabinet has an average internal temperature which is a few degrees below freezing.

8. The apparatus according to claim 7, wherein a bottom area of the storage cabinet has an internal temperature which is about 8° below freezing and at a top area of the storage cabinet has a temperature of more than 2° below freezing.

9. The apparatus according to claim 6, wherein the foodstuffs are meat products.

10. The apparatus according to claim 1, wherein the products are food products.

* * * * *